US007464420B2

(12) United States Patent
Chen et al.

(10) Patent No.: US 7,464,420 B2
(45) Date of Patent: Dec. 16, 2008

(54) INFANT BED

(75) Inventors: Shun-Min Chen, Taipei (TW); Jianqun Li, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 114 days.

(21) Appl. No.: 11/604,775

(22) Filed: Nov. 28, 2006

(65) Prior Publication Data

US 2008/0000023 A1 Jan. 3, 2008

(30) Foreign Application Priority Data

Jun. 30, 2006 (CN) ..... 2006 2 0122139 U

(51) Int. Cl.
*A47D 13/06* (2006.01)

(52) U.S. Cl. ..... 5/98.1; 5/99.1

(58) Field of Classification Search ..... 5/98.1, 5/99.1

See application file for complete search history.

(56) References Cited

U.S. PATENT DOCUMENTS 4,573,224 A * 3/1986 Saint ..... 5/99.1
4,635,305 A * 1/1987 Wyss ..... 5/99.1
5,193,234 A * 3/1993 Joaquin ..... 5/99.1
6,308,352 B1 * 10/2001 Cheng ..... 5/99.1
6,907,626 B1 * 6/2005 Welsh et al. ..... 5/99.1

* cited by examiner

*Primary Examiner*—Michael Trettel
(74) *Attorney, Agent, or Firm*—Bacon & Thomas, PLLC

(57) ABSTRACT

The present invention provides an infant bed including a frame body that is movable between a stretched state and a collapsed state in which the frame body includes: a top frame having a first top frame and a second top frame pivoted with each other; a first leg and a second leg each having an upper end pivotally connected to the top frame and a sliding member movably mounted on each of the first leg and the second leg; a plurality of support frames in which two ends of each support frame being pivotally connected to the top frame and the sliding member respectively; and two links pivoting to each other at one end and the other end of each link is connected to the sliding member; wherein when the frame body is in the stretched state, the links restrict the movement of the sliding member and the first and second top frames of the top frame are in the same plane; and wherein when the frame body is moved from the stretched state to the collapsed state, the sliding member moving along the first leg and the second leg such that the first and second top frames of the top frame are pivoted to each other.

19 Claims, 8 Drawing Sheets

INFANT BED

BACKGROUND OF THE INVENTION

1. Field of the Invention

The present invention relates generally to an infant bed, and more particularly to a frame body of an infant bed that can be collapsed.

2. Art Background

An infant bed is a very essential and convenient device for taking care of children and infants and it is usually designed a sketch of collapsible infant bed and easy in carrying and storage. There are many kinds of conventional collapsing mechanisms of an infant bed to quickly and conveniently collapse the infant bed; for instance, issued U.S. Pat. Nos. 6,434,768, 6,438,772, 6,588,033 and 6,675,413 and a US laid-open publication No. 2003-0070229-A1, where the U.S. Pat. No. 6,588,033 discloses a collapsible bassinet only utilizing a unidirectional hinge disposed in the floor of the bassinet and a plurality of locks, so as to stretch and collapse the main frame body of the bassinet easily and effectively without any structure provided directly below the center of the bassinet floor.

In general, the above-mentioned prior art has some problems and shortcomings on its operation and reliability, and besides, the conventional collapsing mechanism of an infant bed is usually expensive, and difficult in manufacture and combination. In order to overcome the problems described above, an infant bed according to an embodiment of the present invention is disclosed such that the infant bed includes is provided with simple structure, low cost, easy operation, and firm engagement, in addition to the basic functions of collapsing the infant bed.

SUMMARY OF THE INVENTION

Accordingly, one object of the present invention is to provide a collapsing mechanism of an infant bed that is of firm engagement, easy in manufacture and combination.

Another object of the present invention is to provide an infant bed that is collapsed quickly and effectively, and the collapsed infant bed has a compact volume.

To achieve these and other objects, an infant bed including a frame body that is movable between a stretched state and a collapsed state in which the frame body comprising: a top frame having a first top frame and a second top frame pivoted with each other; a first leg and a second leg each having an upper end pivotally connected to the top frame and a sliding member movably mounted on each of the first leg and the second leg; a plurality of support frames in which two ends of each support frame being pivotally connected to the top frame and the sliding member respectively; and two links pivoting to each other at one end and the other end of each link is connected to the sliding member; wherein when the frame body is in the stretched state, the links restrict the movement of the sliding member and the first and second top frames of the top frame are in the same plane; and wherein when the frame body is moved from the stretched state to the collapsed state, the sliding member moving along the first leg and the second leg such that the first and second top frames of the top frame are pivoted to each other.

It is preferred that the first and the second legs are pivoted to each other at the top frame and being in a form of inverted V-shape when the frame body is in the stretched state.

It is preferred that each of the first and second top frames of the top frame includes two first portions and a second portion disposed between the two first portions and pivotally connected to the two first portions, the first leg and the second leg each includes an upper-leg portion and an lower-leg portion pivotally connected to the upper-leg portion, when the frame body is in the collapsed state, the first portions and the second portion of the top frames are pivoted to each other and the upper-leg portion and the lower-leg portion are pivoted to each other so as to reduce the volume of the infant bed.

It is preferred that the frame body further includes a plurality of connecting devices disposed in the top frame, the first portions and the second portion are pivotally connected with each other through the connecting devices, and one end of the support frames is pivotally connected to the connecting devices.

It is preferred that the frame body further includes a bottom frame disposed between the first and the second legs so as to keep the frame body in the stretched state.

It is preferred that the bottom frame includes a first bottom frame and a second bottom frame being pivoted to each other at one end and the other end of the first bottom frame and the second bottom frame that are pivotally connected to the first leg and the second leg respectively, and when the first bottom frame and the second bottom frame are pivoted to each other, the frame body is moved from the stretched state to the collapsed state.

It is preferred that the first leg and the second leg each includes two leg members that are connected to each other by a bottom cross rod.

It is preferred that the first leg and the second leg each includes two leg members, two auxiliary support frames pivotally connected to the two leg members respectively, two ends of the bottom frames are pivotally connected to each of the auxiliary support frames.

It is preferred that the frame body further includes a plurality of support feet mounted on a lower end opposited to the upper end of the first leg and the second leg and the support feet are removable.

It is preferred that the frame body further includes two anchor blocks disposed on the top frames, and the first and second top frames and the first leg and the second leg are both pivotally connected to the anchor blocks.

It is preferred that the first leg and the second leg each includes a sleeve disposed around the leg, and the sleeve is pivotally connected to the bottom cross rods.

It is preferred that the links are in an inverted V-shape when the frame body is in the stretched state.

Besides, an infant bed including a frame body that is movable between a stretched state and a collapsed state in which the frame body comprising: a top frame having a first top frame and a second top frame pivoted with each other; a first leg and a second leg each having an upper end pivotally connected to the top frame and a lower end opposited to the upper end; a plurality of support frames in which each of two ends of the support frames being pivotally connected to the top frame and one of the first leg and the second leg respectively; a bottom frame disposed between the first leg and the second leg, and includes a first bottom frame and a second bottom frame being pivoted to each other at one end and the other end of the first bottom frame and the second bottom frame are pivotally connected to the lower end of the first leg and second leg respectively; wherein when the frame body is in the stretched state, the support frame retains the first and second top frames of the top frame in the same plane; wherein when the first bottom frame and the second bottom frame are pivoted to each other so as to move the frame body to the collapsed state, the first leg and the second leg are moved toward each other so that support frame is pulled and the first and second top frames of the top frame are pivoted to each other, and wherein each of the first and second top frames of the top frame includes two first portions and a second portion disposed between the two first portions and pivotally connected to the two first portions, the first leg and the second leg each includes an upper-leg portion and an lower-leg portion pivotally connected to the upper-leg portion, when the frame body is in the collapsed state, the first portions and the second portion of the top frames are pivoted to each other and the upper-leg portion and the lower-leg portion are pivoted to each other so as to reduce the volume of the infant bed.

It is preferred that the first and the second legs are pivoted to each other at the top frame and being in a form of inverted V-shape when the frame body is in the stretched state.

It is to be understood that both the forgoing general description and the following detailed description are exemplary and explanatory and are intended to provide a further non-limiting explanation of the invention as claimed.

BRIEF DESCRIPTION OF THE DRAWINGS

For a more complete understanding of the present invention and the advantages thereof, reference is now made to the following description taken in conjunction with the accompanying drawings, wherein.

DETAILED DESCRIPTION

Figure 1:
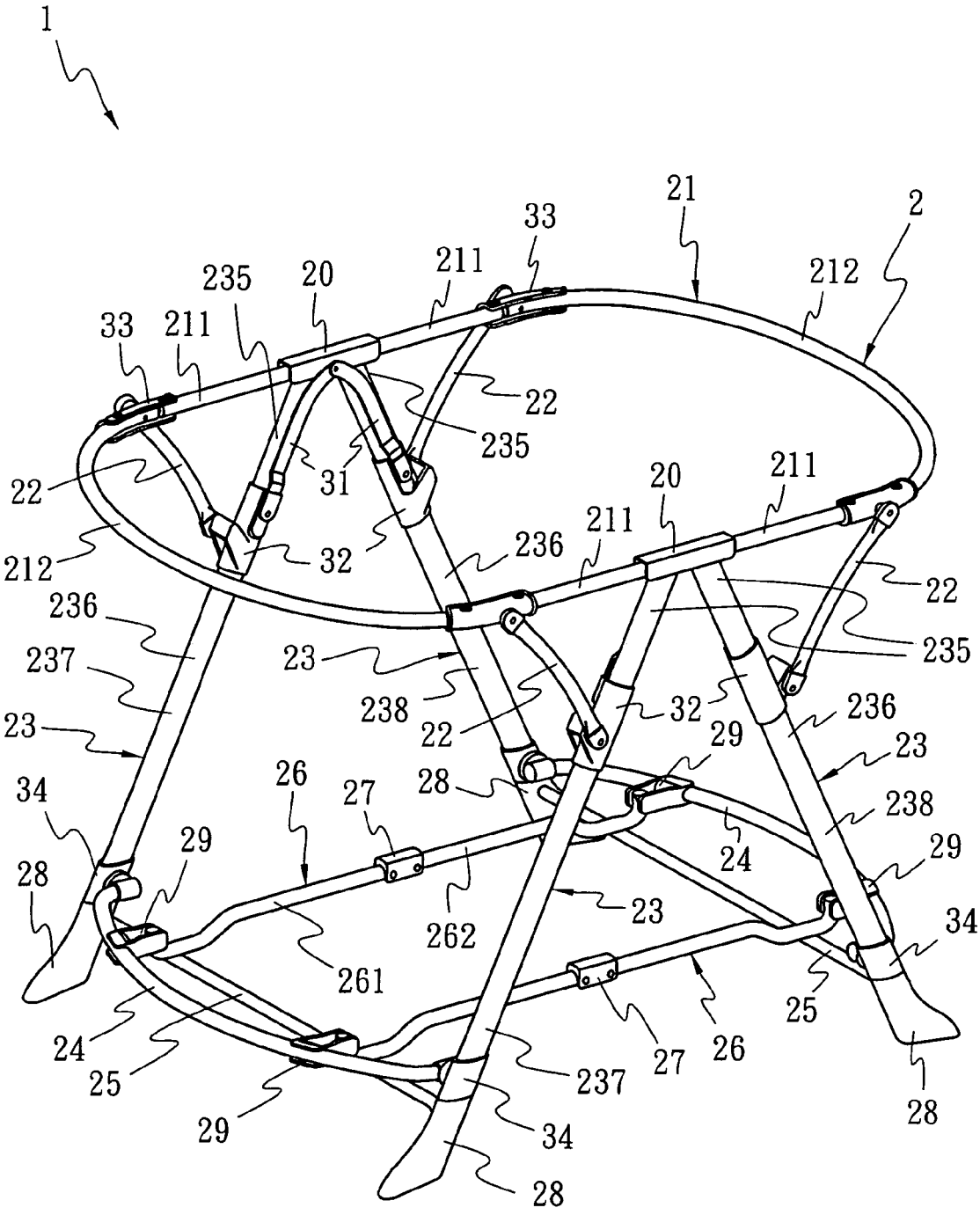
FIG. 1 is a schematic view illustrating the entire appearance of an infant bed according to an embodiment of the present invention.

Referring now to the drawings in which an embodiment of the present invention is illustrated to describe the present invention.

The Main Structure

First, the entire appearance of an infant bed 1 and its structure according to an embodiment of the present invention will be set forth in the description. As shown in FIG. 1, the infant bed 1 mainly includes a frame body 2 and the frame body 2 includes a top frame 21 that is substantially in a form of elliptic shape, a plurality of legs 23 each having an upper end pivotally connected below the top frame 21, a plurality of support frames 22 in which each two ends thereof are pivotally connected to the top frame 21 and the legs 23 respectively, two anchor blocks 20 disposed on the top frame 21 and positioned on the junction of the top frame 21 and legs 23, a plurality of support feet 28 each disposed around an lower end opposite to the upper end of each leg 23, a plurality of bottom cross rods 25 each connecting between the legs and two bottom frames 26 disposed below the top frame 21 and connected to the lower end of the leg 23. The top frame 21 has a first top frame and a second top frame in a substantially U-shape and the first top frame and the second top frame are pivotally connected to each other at the anchor blocks 20, and each of the first top frame and the second top frame includes two first tube portions 211 and a second tube portion 212 disposed between the two first tube portions 211. The first tube portions 211 and the second tube portion 212 are pivotally connected with each other through a connecting device 33. The plurality of legs 23 in this embodiment includes a first leg 237 and a second leg 238 pivoting to each other at the anchor block 20 and formed in a substantially inverted V-shape, in which the first leg 237 and the second leg 238 includes two leg members respectively that are connected through an auxiliary support frame 24. The first leg 237 and the second leg 238 are connected to each other through the bottom frames 26. In addition, it should be appreciated that, in one preferred embodiment of the present invention, the first tube portion and the second tube portion may pivotally rotate with each other; it is illustrative but not limit the scope and the two tube portions that are not pivotally rotate with each other are also acceptable in another preferred embodiment.

In addition, the frame body 2 further includes a plurality of links 31 and a plurality of sliding members 32. In the preferred embodiment, the sliding member 32 is slidably mounted on the leg member of each of the first leg 237 and the second leg 238, and each upper end of the two adjacent links 31 is pivotally connected to each other by a fastening member and each lower end of the two adjacent links 31 is attached to the sliding members 32, and two ends of the support frame are pivotally connected to the connecting device 33 and the sliding member 32 respectively.

Besides, each leg member of the first leg 237 and the second leg 238 includes a sleeve 34 disposed at the lower end thereof, and the auxiliary support frame 24 are pivotally connected to the sleeve 34, each of two ends of the bottom frames 26 is connected to the first leg 237 and the second leg 238 respectively by attaching the two auxiliary support frame 24 through a fastening mechanism 29, such that the first leg 237 and the second leg 238 may keep in a stretched state at a angle; the bottom frames 26 includes a first bottom frame 261 and a second bottom frame 262 and an joint 27 in which each two end thereof is pivotally connected to the first bottom frame 261 and the second bottom frame 262, and the first bottom frame 261 and the second bottom frame 262 may pivot to each other when the frame body 2 is moved from the stretched state to the collapsed state. It should be appreciated that, in the preferred embodiment, the fastening mechanism 29 is attached to the auxiliary support frame 24 and the first bottom frame 261 and the second bottom frame 262 of each bottom frame 26 is pivotally connected to the fastening mechanism 29.

Figure 2:
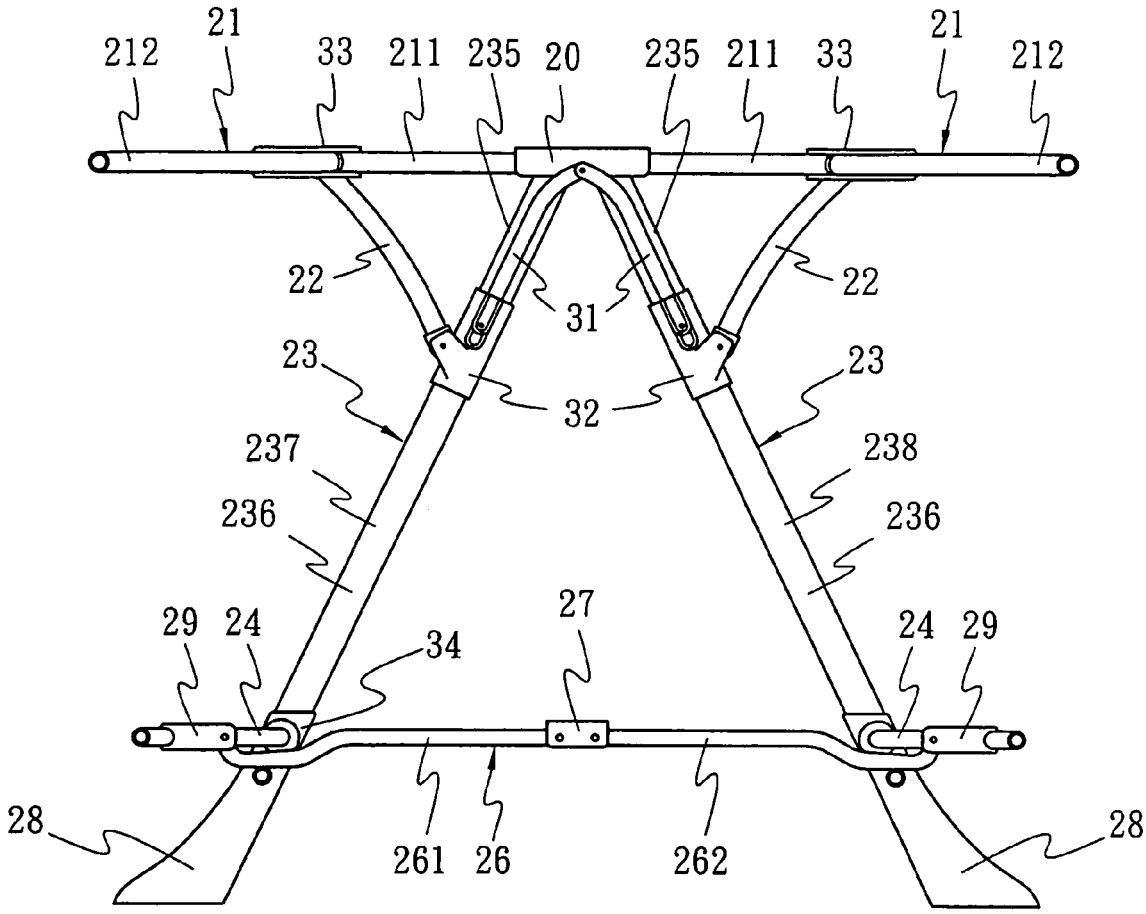
FIG. 2 is a side view illustrating the frame body of the infant bed according to the embodiment of the present invention.
Figure 3:
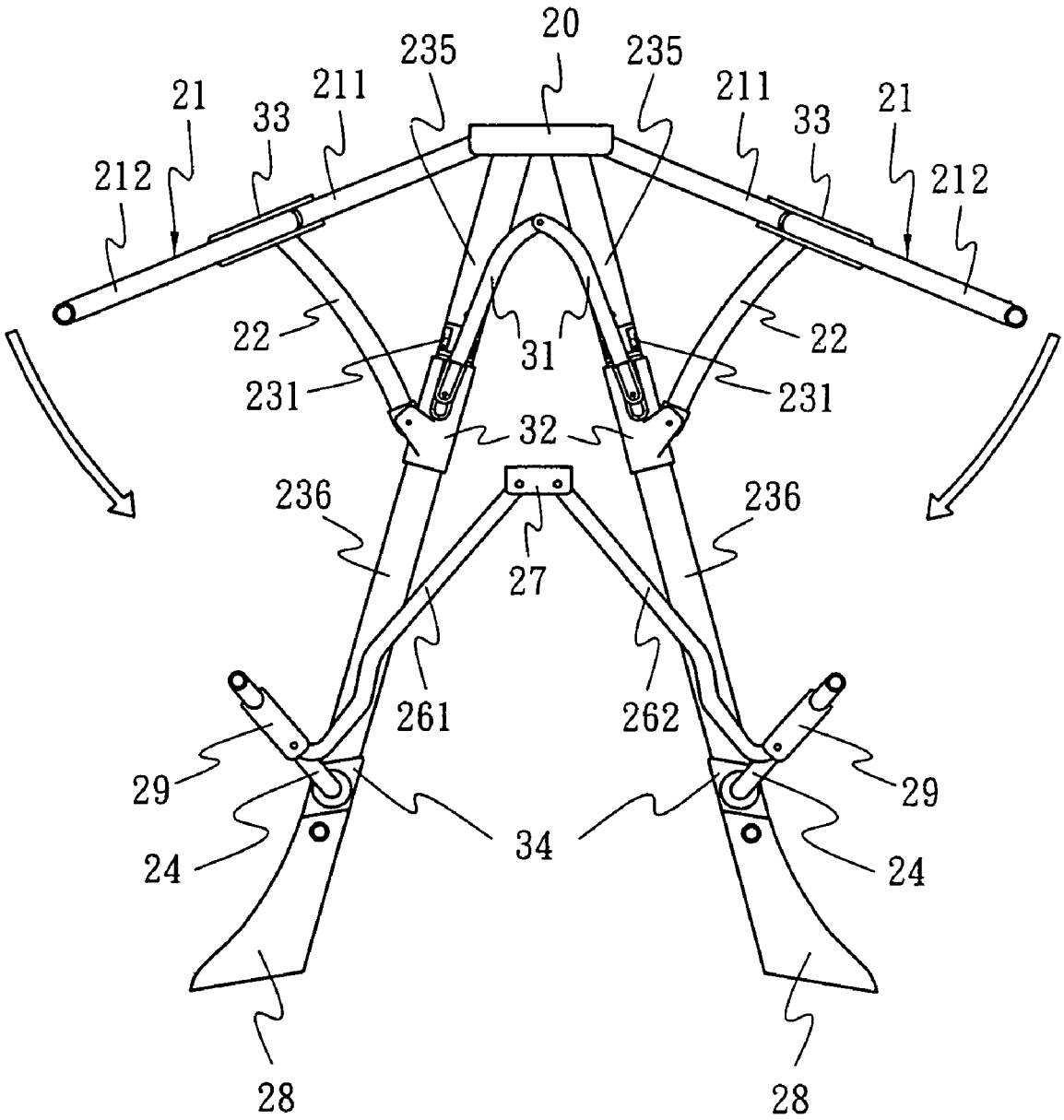
FIG. 3 is side view illustrating the frame body of the infant bed when the frame body is in a partially collapsed state according to the embodiment of the present invention.
Figure 6A:
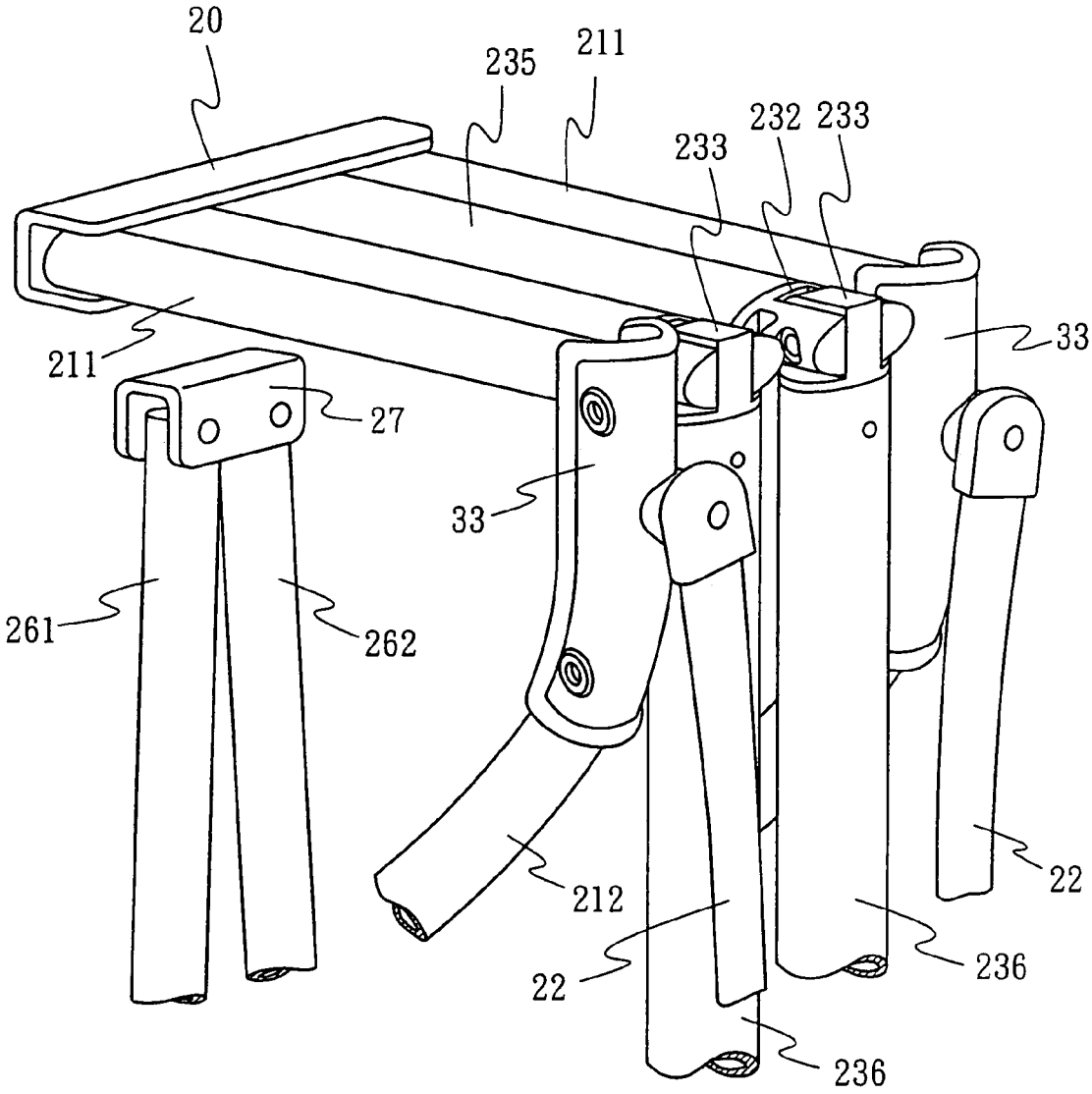
FIG. 6A is a partial view of a pivot joint of legs according to the embodiment of the present invention.
Figure 6B:
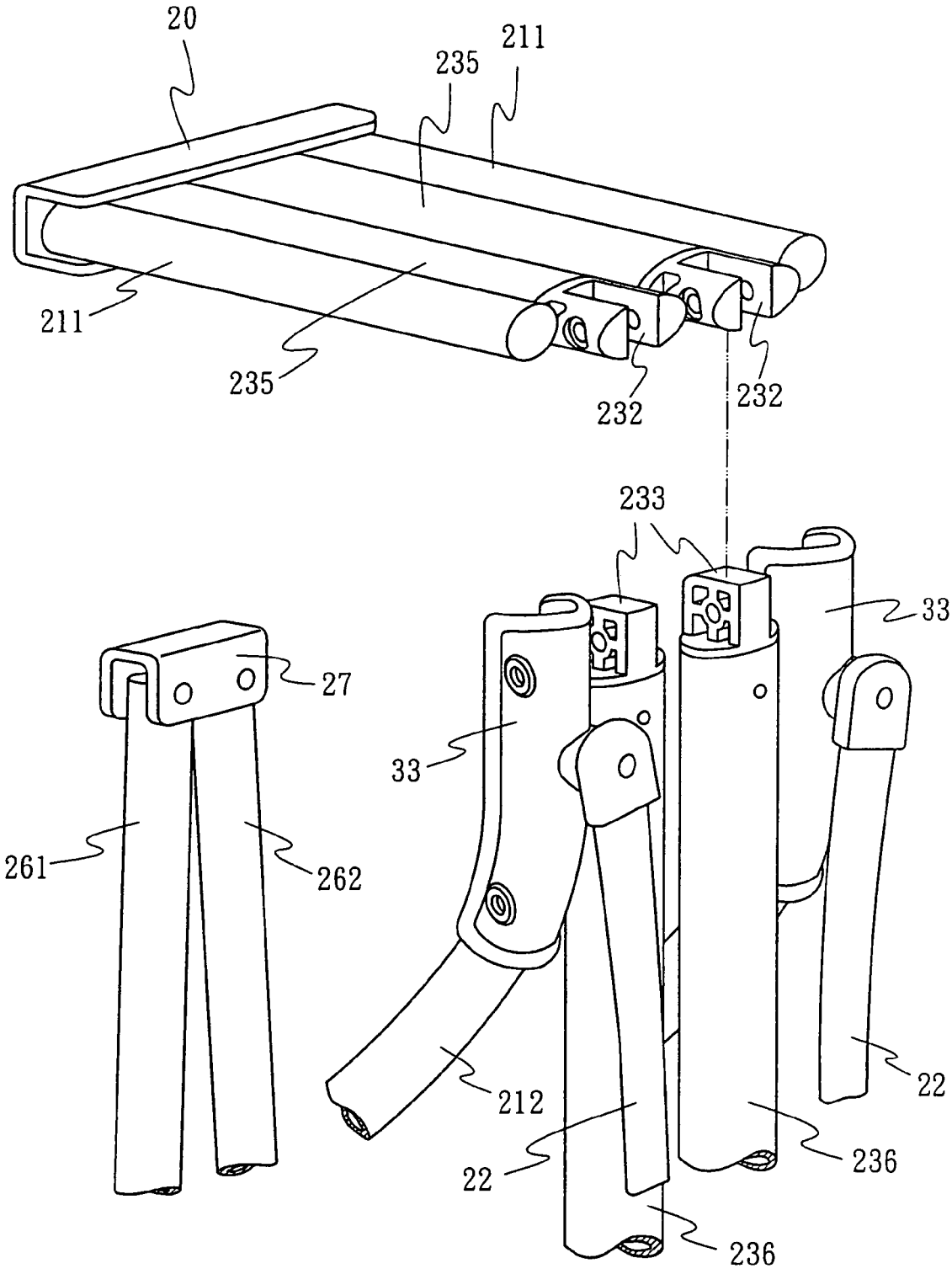
FIG. 6B is another partial view of a pivot joint of legs according to the embodiment of the present invention.

As shown in FIGS. 1 and 2, the sliding members 32 are slid along each leg member of the first leg 237 and the second leg 238. The support feet 28 are connected to the lower end of each leg member for keeping steady when the frame body 2 is in a stretched state, and the support feet 28 are removable. Further, each of the first leg 237 and the second leg 238 includes an upper-leg portion 235 and an lower-leg portion 236 that are pivotally connected with each other respectively through a pivot joint 231, as shown in FIG. 3. Also, as shown in FIGS. 6A and 6B, in the preferred embodiment, the pivot joint 231 includes a depressed portion 232 on the upper-leg portion 235 and a protruding portion 233 on the lower-leg portion 236, and the depressed portion 232 and the protruding portion 233 are pivoted with each other for further collapsing the frame body 2 of the infant bed 1, and FIG. 4B shows the infant bed 1 having a compact volume after collapsing. It should be noted that the above-mentioned manner is an example of combination method between the depressed portion 232 and the protruding portion 233 but not to limit the scope; any component in the related art that is enable to pivotally rotate is acceptable; and the depressed portion 232 and the protruding portion 233 may exchange the locations thereof.

The Operation Manner

As shown in FIGS. 1 and 3, the operation method of the frame body 2 according to an embodiment of the present invention will be described in the following.

When the frame body 2 of the infant bed 1 is in a stretched state, the first leg 237 and the second leg 238 are stretched at an angle and formed in an inverted V-shape, and two adjacent links 31 are stretched in an inverted V-shape so that the sliding member 32 cannot downwardly slide, and the top frame 21 is supported by the support frame 22 so as to maintain the first top frame and the second top frame of the top frame 21 in the same horizontal stretched position, and the two second tube portions 212 are far away each other at this time.

Figure 4A:
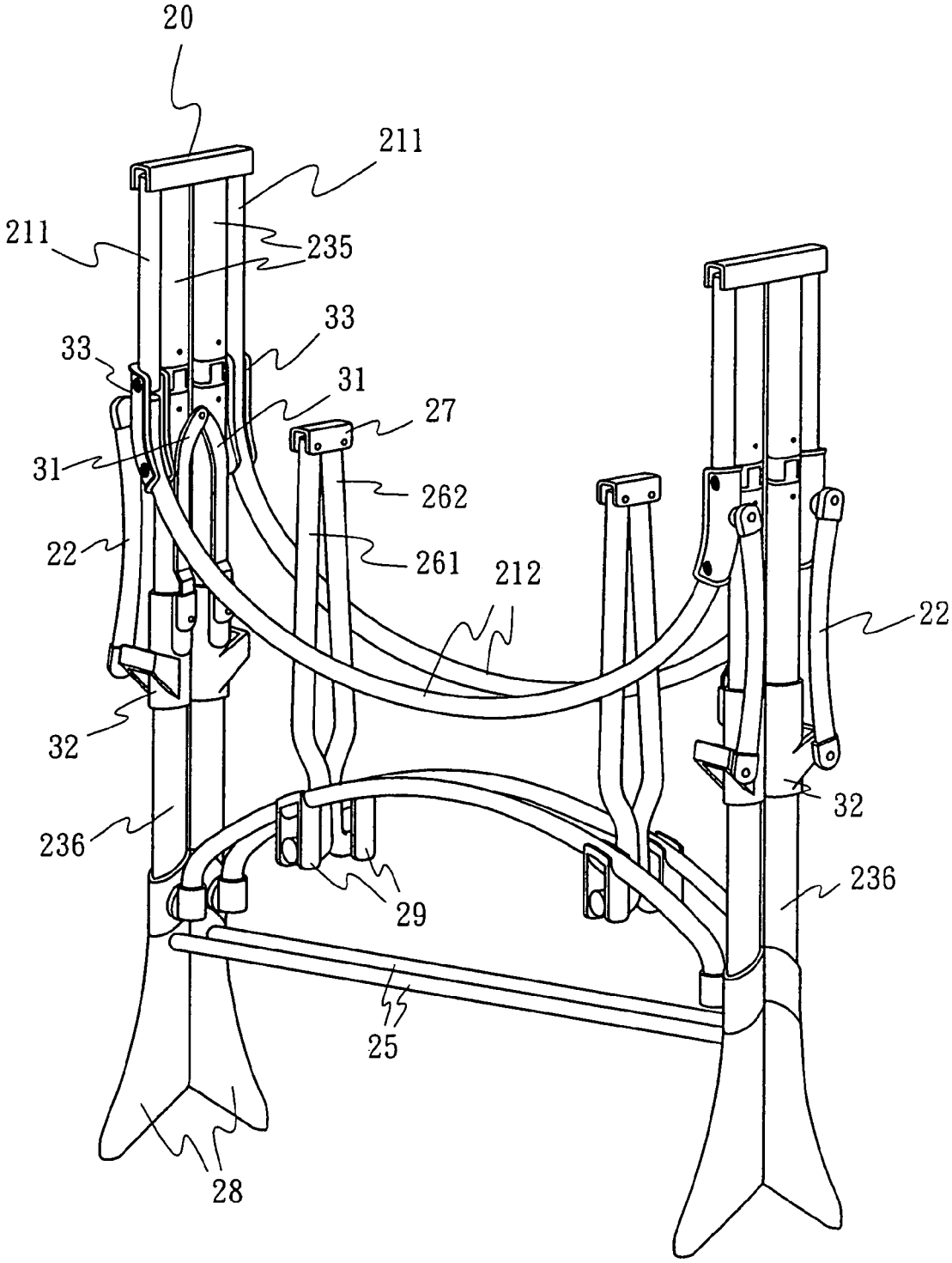
FIGS. 4A and 4B are schematic views illustrating the entire appearance of the frame body in a collapsed state according to the embodiment of the present invention, and the legs, shown in FIG. 4B are foldable to allow the collapsed infant bed become a compact volume.
Figure 4B:
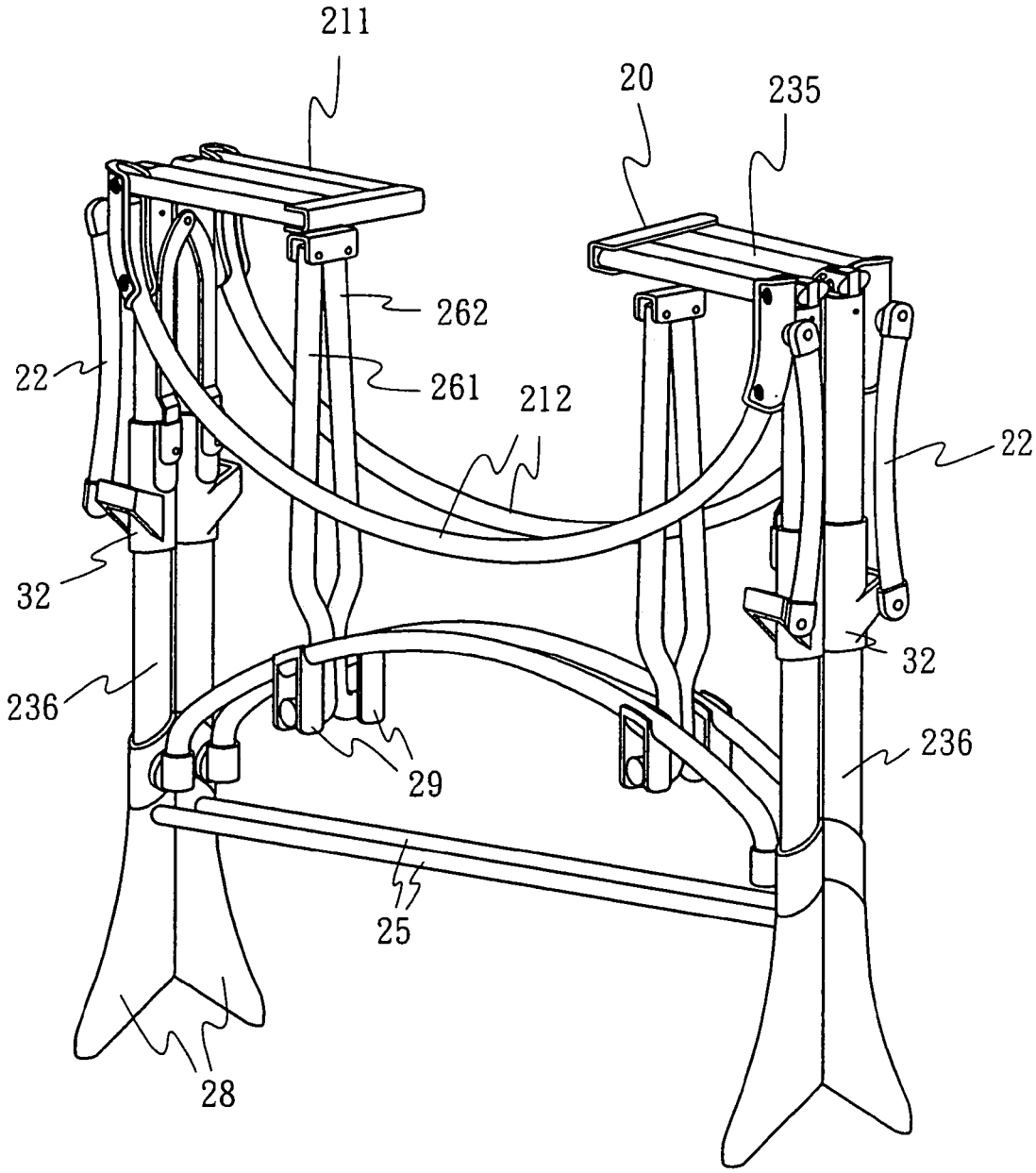
Figure 5:
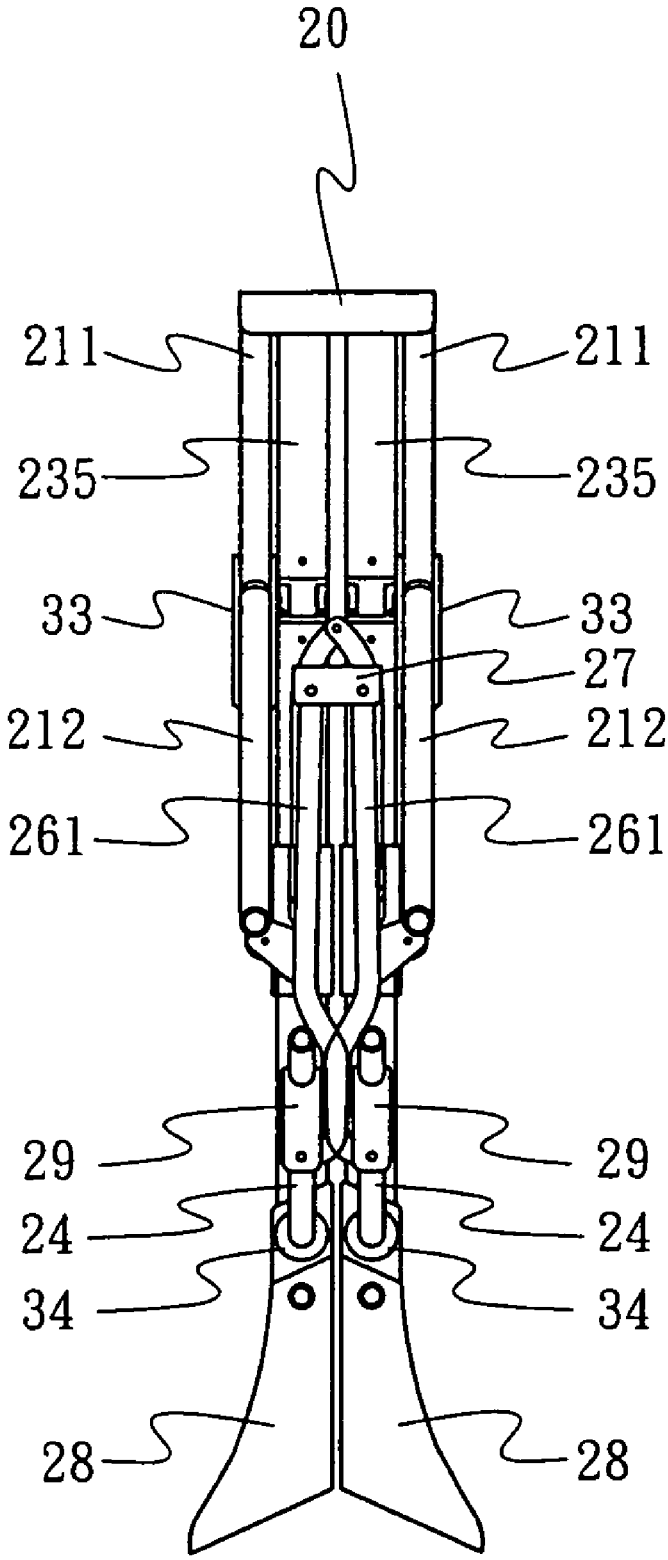
FIG. 5 is side view illustrating the frame body of the infant bed in a collapsed state according to the embodiment of the present invention.

Further, when a user intends to collapse the frame body 2 of the infant bed 1, he/she lifts the bottom frames 26 upwardly, and then the first bottom frame 261 and the second bottom frame 262 may pivotally rotate with each other (as shown in FIG. 3), the first leg 237 and the second leg 238 are approached where the support feet 28 are moved toward each other, and the sliding member 32 slides downwardly since the angle between the first leg 237 and the second leg 238 is reduced and two adjacent links 31 are pivoted to each other, and the first top frame and the second top frame of the top frame 21 would pivot to each other and drop down automatically (as shown in the arrow of FIG. 3) under the movement of the support frame 22, and the two second tube portions 212 are approach with each other at this time, thereby the frame body 2 of the infant bed 1 is in the collapsed state (as shown in FIGS. 4A and 5). On the other hand, when a user intends to stretch out the infant bed 1, he/she lifts the first top frame and the second top frame of the top frame 21 to allow the sliding member 32 move upwardly through the support frame 22, and the bottom frame 26 and the two adjacent links 31 are stretched accordingly so as to maintain the top frames 21 in a horizontal plane (as shown in FIG. 1) and thereby the frame body 2 of the infant bed 1 is stretched.

As shown in FIG. 4B, when a user intends to further package the infant bed 1 when the frame body 2 of the infant bed 1 is in the collapsed state, he/she may remove the support feet 28 and let the first top frame and the second top frame of the top frame 21 bend inwardly since the first top frame portion 211 and the second top frame portion 212 may pivotally rotate with each other and the upper-leg portion 235 and the lower-leg portion 236 may pivotally rotate with each other too, and thus it would reduce the volume of the infant bed 1.

According to the above-mentioned, provided is a frame body 2 enable to quickly collapse an infant bed 1 and an infant bed 1 having the frame body 2 according to the embodiments of the present invention, and its structure are indeed different with the related prior art and the improved frame body 2 of an infant bed 1 could indeed achieve the purposes and the features of the present invention.

The above-described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

What is claimed is:

1. An infant bed including a frame body that is movable between a stretched state and a collapsed state, the frame body comprising:

a top frame having a first top frame and a second top frame pivoted with each other;

a first leg and a second leg each having an upper end pivotally connected to the top frame and a sliding member movably mounted on each of the first leg and the second leg;

a plurality of support frames each having two ends pivotally connected respectively to the top frame and one of the sliding members; and two links having first ends pivotally connected to each other, wherein each link has a second end pivotally connected respectively to said sliding members;

wherein when the frame body is in the stretched state, the links restrict the movement of the sliding member and the first and second top frames of the top frame are in the same plane, and wherein when the frame body is moved from the stretched state to the collapsed state, the sliding members move respectively along the first leg and the second leg such that the first and second top frames of the top frame are pivoted with respect to each other.

2. The infant bed according to claim 1, wherein the first and the second legs are pivoted to each other at the top frame and being in a form of inverted V-shape when the frame body is in the stretched state.

3. The infant bed according to claim 1, wherein each of the first and second top frames of the top frame includes two first portions and a second portion disposed between the two first portions and pivotally connected to the two first portions, the first leg and the second leg each includes an upper-leg portion and an lower-leg portion pivotally connected to the upper-leg portion, when the frame body is in the collapsed state, the first portions and the second portion of the top frames are pivoted to each other and the upper-leg portion and the lower-leg portion are pivoted to each other so as to reduce the volume of the infant bed.

4. The infant bed according to claim 3, wherein the frame body further includes a plurality of connecting devices disposed in the top frame, the first portions and the second portion are pivotally connected with each other through the connecting devices, and one end of the support frames is pivotally connected to the connecting devices.

5. The infant bed according to claim 1, wherein the frame body further includes a bottom frame disposed between the first and the second legs so as to keep the frame body in the stretched state.

6. The infant bed according to claim 2, wherein the frame body further includes a bottom frame disposed between the first and the second legs so as to keep the frame body in the stretched state.

7. The infant bed according to claim 5, wherein the bottom frame includes a first bottom frame and a second bottom frame being pivoted to each other at one end and the other end of the first bottom frame and the second bottom frame that are pivotally connected to the first leg and the second leg respectively, and when the first bottom frame and the second bottom frame are pivoted to each other, the frame body is moved from the stretched state to the collapsed state.

8. The infant bed according to claim 6, wherein the bottom frame includes a first bottom frame and a second bottom frame being pivoted to each other at one end and the other end of the first bottom frame and the second bottom frame that are pivotally connected to the first leg and the second leg respectively, and when the first bottom frame and the second bottom frame are pivoted to each other, the frame body is moved from the stretched state to the collapsed state.

9. The infant bed according to claim 1, wherein the first leg and the second leg each includes two leg members that are connected to each other by a bottom cross rod.

10. The infant bed according to claim 8, wherein the first leg and the second leg each includes two leg members that are connected to each other by a bottom cross rod.

11. The infant bed according to claim 8, wherein the first leg and the second leg each includes two leg members, two auxiliary support frames pivotally connected to the two leg members respectively, two ends of the bottom frames are pivotally connected to each of the auxiliary support frames.

12. The infant bed according to claim 1, wherein the frame body further includes a plurality of support feet mounted on a lower end opposited to the upper end of the first leg and the second leg and the support feet are removable.

13. The infant bed according to claim 8, wherein the frame body further includes a plurality of support feet mounted on a lower end opposited to the upper end of the first leg and the second leg and the support feet are removable.

14. The infant bed according to claim 1, wherein the frame body further includes two anchor blocks disposed on the top frames, and the first and second top frames and the first leg and the second leg are both pivotally connected to the anchor blocks.

15. The infant bed according to claim 2, wherein the frame body further includes two anchor blocks disposed on the top frames, and the first and second top frames and the first leg and the second legs are both pivotally connected to the anchor blocks.

16. The infant bed according to claim 9, wherein the first leg and the second leg each includes a sleeve disposed around the leg, and the sleeve is pivotally connected to the bottom cross rods.

17. The infant bed according to claim 1, wherein the links are in an inverted V-shape when the frame body is in the stretched state.

18. An infant bed including a frame body that is movable between a stretched state and a collapsed state, the frame body comprising:

a top frame having a first top frame and a second top frame pivoted with each other;

a first leg and a second leg each having an upper end pivotally connected to the top frame and a lower end opposite the upper end;

a plurality of support frames each having two ends pivotally connected respectively to the top frame and one of the first leg and the second leg;

a bottom frame disposed between the first leg and the second leg and including a first bottom frame and a second bottom frame pivoted to each other at a first end, a second end of the first bottom frame and the second bottom frame being pivotally connected to the lower end of the first leg and second leg respectively;

wherein when the frame body is in the stretched state, the support frame retains the first and second top frames of the top frame in the same plane; and when the first bottom frame and the second bottom frame are pivoted to each other so as to move the frame body to the collapsed state, the first leg and the second leg are moved toward each other so that the support frames are pulled and the first and second top frames of the top frame are pivoted with respect to each other;

wherein each of the first and second top frames of the top frame includes two first portions and a second portion disposed between the two first portions and pivotally connected to the two first portions, the first leg and the second leg each includes an upper-leg portion and an lower-leg portion pivotally connected to the upper-leg portion, when the frame body is in the collapsed state, the first portions and the second portion of the top frames are pivoted to each other and the upper-leg portion and the lower-leg portion are pivoted to each other so as to reduce the volume of the infant bed.

19. The infant bed according to claim 18, wherein the first and the second legs are pivoted to each other at the top frame and being in a form of inverted V-shape when the frame body is in the stretched state.

* * * * *